United States Patent [19]

Hurley

[11] Patent Number: 4,756,643

[45] Date of Patent: Jul. 12, 1988

[54] APPARATUS FOR PLACEMENT OF LATERAL DRAIN LINES ONTO A MAIN DRAINAGE LINE FOR PREFABRICATED COMPOSITE DRAINAGE STRUCTURES

[76] Inventor: Dennis Hurley, P.O. Box 702, Marrero, La. 70073

[21] Appl. No.: 855,954

[22] Filed: Apr. 25, 1986

[51] Int. Cl.[4] ..... F02B 11/00

[52] U.S. Cl. ..... 405/43; 405/36; 405/45

[58] Field of Search ..... 405/36, 43, 45, 48, 405/49, 50; 52/169.5; 403/205, 382

[56] References Cited

U.S. PATENT DOCUMENTS

| | | | |
|---|---|---|---|
| 3,525,663 | 8/1970 | Hale | 405/36 |
| 3,654,765 | 4/1972 | Healy et al. | 405/45 |
| 3,711,633 | 1/1973 | Ghirardi et al. | 285/156 |
| 4,572,700 | 2/1986 | Mantarro et al. | 405/45 |
| 4,574,541 | 3/1986 | Raidt et al. | 405/45 |
| 4,622,138 | 11/1986 | Wager | 405/45 |

FOREIGN PATENT DOCUMENTS

| | | | |
|---|---|---|---|
| 1017582 | 9/1977 | Canada | 405/36 |
| 0116912 | 9/1980 | Japan | 405/43 |
| 0116914 | 9/1980 | Japan | 405/43 |

*Primary Examiner*—Dennis L. Taylor

*Attorney, Agent, or Firm*—Pravel, Gambrell, Hewitt, Kimball & Krieger

[57] ABSTRACT

A geotextile fabric composite sleeve having three interconnected portions so that two of the portions are slidable over the principal drain line, and define a main sleeve portion and the third portion for accommodating a lateral line for defining an auxiliary sleeve portion in fluid communication with the main sleeve portion, the auxiliary sleeve portion projecting out flexible to any angle from the main sleeve portion, with the main sleeve portion position onto the principle drain line at a point so that the opening of the auxiliary sleeve portion into the main sleeve portion is that the window cut into the main sleeve.

9 Claims, 4 Drawing Sheets

APPARATUS FOR PLACEMENT OF LATERAL DRAIN LINES ONTO A MAIN DRAINAGE LINE FOR PREFABRICATED COMPOSITE DRAINAGE STRUCTURES

BACKGROUND OF THE INVENTION

1. Field Of The Invention:

The apparatus of the present invention relates to prefabricated composite drain structures, particularly useful in draining land areas such as golf courses. More particularly, the present invention relates to a sleeve-like coupling for coupling a lateral drainage line onto the principal drainage structure in a prefabricated composite drainage structure.

2. General Background:

The proper drainage of rain water from various types of land usage situations, such as buildings, streets, parks, recreational areas, is crucial in maintaining the integrity of the land for proper usage. In the present state of the art, one of the most effective means of drainage, for example, away from foundations of buildings, is through the use of prefabricated composite drainage structures which generally include an outer fabric such as a geotextile layer that accommodates the flow of water through the fibers yet filters out nearly all soil particles being carried along the flow of water. There is further included an inner core which consists of a flexible polystyrene core, which is presently covered under U.S. Pat. Nos. 3,563,038 and U.S. Pat. No. 3,654,765 which consists of a flexible polystyrene core member having a plurality of raised portions throughout the surface of the core layer so that the surrounding fabric does not collapse against the inner core as the water is filtered therethrough, yet the spaced apart raised members provide a flow space therebetween for flow of water out of the core member structure following the flow through the fabric layer. This prefabricated composite drain for major structure land areas has become a known replacement for the aggregate or "French Drains".

Another important use of the composite drainage structure in addition to the drainage of water around large structures such as buildings, is to utilize the drainage structure in a somewhat different mode for drainage of land areas, more particularly for drainage of golf courses or the like. What is provided is that the internal flexible polystyrene core member is cut into strips approximately 3 inches to 1 foot high, with 6 inches being the most common. The strips of polystyrene are placed within a geotextile fabric sleeve, with the sleeve covering the continuous strength of the strip. A ditch or the like is dug in the land along the border of the land to be drained in the appropriate water collection support points, and the structure is laid on edge within the ditch, and would be back filled with sand or native soils. Therefore, as water flows, due to rain, irrigation or the like, would force the water through the geotextile filter, to the inside of the polystyrene core down to the drainage point in the land, the hydro static pressure would force the water through the geotextile outer fabric filter layer, to the inside of the strip in the flexible polystyrene core. Once the water has entered the free flowing area it continues to flow along the plastic core with no internal pressure to force it back to the outside. As long as there prevails a minimum slope of 1%, water will continue to flow to an outlet point such as a collection basin, outlet pipe or larger drainage canal.

In order to drain wide areas as efficiently as possible a system of lateral drains are used to collect water from areas outside of the collection areas serviced by the main line. These laterals funnel the water into one main drain which is used to carry all of the collected water to the collection basin, outlet pipe, or larger drainage canal. It has been learned that a series of lateral drains flowing into the main drain structure provides additional water to be channeled into the main structure, and at the point where the water flow enters the main drain structure from the lateral drain structure, the velocity of water flow can be increased if the water from the lateral drain enters the main drain at the correct angle, and enters without any interference. In attempting to form a proper juncture at the point where the lateral drain structures feed into the main drain structure, a continuing problem has arisen. Due to the fact that both the main drain line and the lateral lines have internal polystyrene core with the filter fabric sleeve surrounding it, it is necessary then that the water from the lateral drain lines flow easily into the main drain line. This is accomplished basically in two methods.

The first method would encompass having the one end portion of the lateral drain line angularly abut the outer surface of the fabric filter, without actually breaking into the core area. The result would be that as the water flow flows out of the lateral drain line and into the surrounding media it must then be reabsorbed through the filter fabric of the main drain line so that it passes into the water collection space of the core members and likewise flows along the main flow. This presents two problems. One being that water flow must be interrupted in order to be reabsorbed through the fabric surrounding the main drain line prior to continuing on its flow. Secondly, the feed of the lateral must necessarily be left open to allow the water to exit freely. This makes it very possible for dirt to naturally enter this lateral line at this point. As the water table rises and falls, over a period of time, this could severally clog the lateral drain.

The second method is to cut a window in the fabric of the main line, and insert an end portion of the lateral drain line angularly into that window so that the main drain line makes direct contact into the internal flow spaces of the internal core member. This method also has its shortcomings. One short-coming is the fact that the fabric layer or the core member of the lateral line often times projects into the interspaces between the projections of the core member and impedes the flow of water through the main line acting as a barier in that flow space. If this problem can be overcome, the second serious problem is that the window in the main drain line, while accommodating a structure of the lateral drain, also allows foreign particles, which have been henceforth filtered by the fabric, to enter the water flow, for example, dirt or the like, and ultimately impede the flow to the point where it can become blocked as dirt would accumulate between the projections in the core member.

Therefore, what is needed is a method or structure for accommodating the juncture point of a lateral flow line into a main flow line for solving the problems as were discussed earlier.

SUMMARY OF THE PRESENT INVENTION

The apparatus and method of the present invention solves the shortcomings in the art in a simple and straightforward manner. In a main drain line having an internal polystyrene core member surrounded by a geotextile outer fabric filter material, wherein a window has been cut into the fabric material to accommodate a lateral drain line also comprising a flexible polystryene core and a geotextile outer fabric filter, what is provided is a geotextile fabric composite sleeve having three interconnected portions so that two of the portions are slidable over the principal drain line, and define a main sleeve portion and the third portion for accommodating a lateral line for defining an auxiliary sleeve portion in fluid communication with the main sleeve portion, the auxiliary sleeve portion projecting out flexible to any angle from the main sleeve portion, with the main sleeve portion position onto the principle drain line at a point so that the opening of the auxiliary sleeve portion into the main sleeve portion is that the window cut into the main sleeve. Following the positioning of the sleeve in the aforesaid position, the lateral drain line is then slid into the auxiliary sleeve to a point where the inner core abuts the edge of the fabric layer of the main drain line, but does not project into the flow spaces. The composite sleeve is then secured at its open end portions so that foreign particles such as dirt or the like is not allowed to enter into the juncture window, and flow in the lateral drain line into the main drain line is unimpeded and in fact accelerated. In view of the fact that the composite sleeve is made up of three equal portions, the auxiliary sleeve portion for accommodating the lateral line could therefore be shiftable from the left to the right side of the main line depending on the point at which the lateral is coming into the main line.

Therefore, it is an object of the present invention to provide a composite sleeve structure for accommodating a lateral drain line into a main drain line while preventing the introduction of foreign material into the water flow.

It is still a further object of the present invention to provide a composite sleeve which allows the cutting of a window into the fabric of a main flow drain line to accommodate a lateral flow line thereinto yet does not allow foreign particles thereinto.

It is still a further object of the present invention to provide a method for placing a lateral drain line into a main drain line yet preventing introduction of any foreign particles into the fluid flow at point of introduction.

It is still a further object of the present invention to provide a flexible composite sleeve accommodated onto a water drain line for allowing a lateral flow line to be introduced into the main flow line at any necessary angle in order to facilitate the flow of water through the main line.

It is still a further object of the present invention to provide a composite sleeve member at the juncture of a lateral flow line being introduced into a main flow line so that it is assured that the main flow line is not impeded due to the internal structure of the lateral flow line blocking flow in the main flow line.

DETAILED DESCRIPTION OF THE PREFERRED EMBODIMENT

Figure 3:
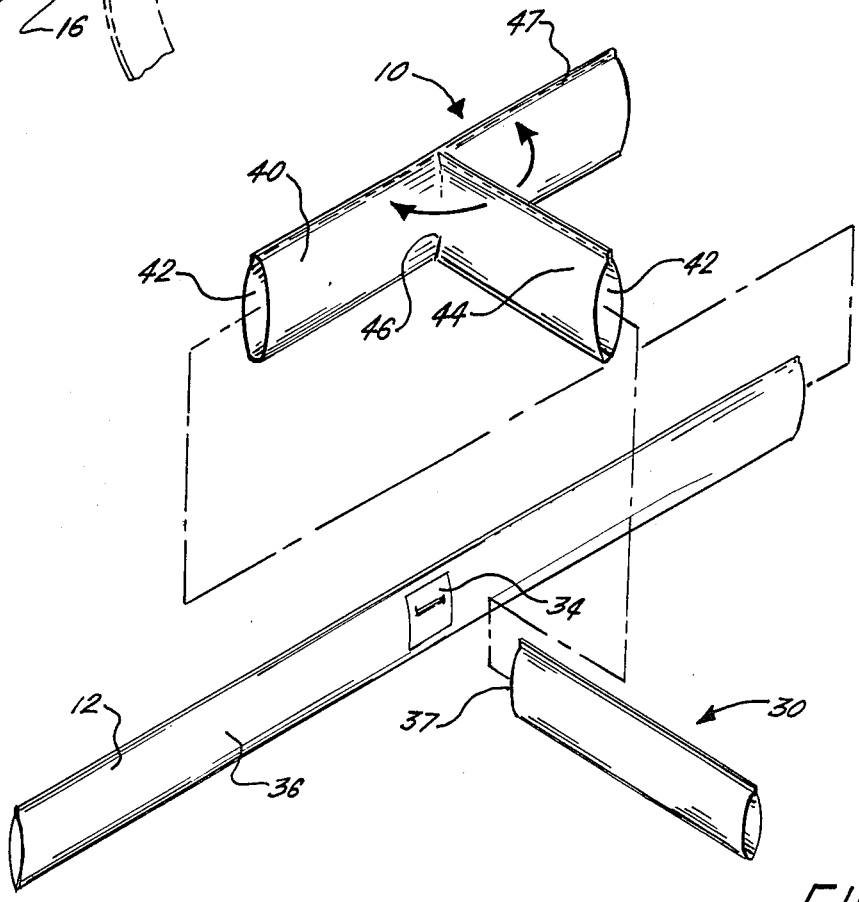
FIG. 3 is an exploded view of the preferred embodiment of the apparatus of the present invention.
Figure 4:
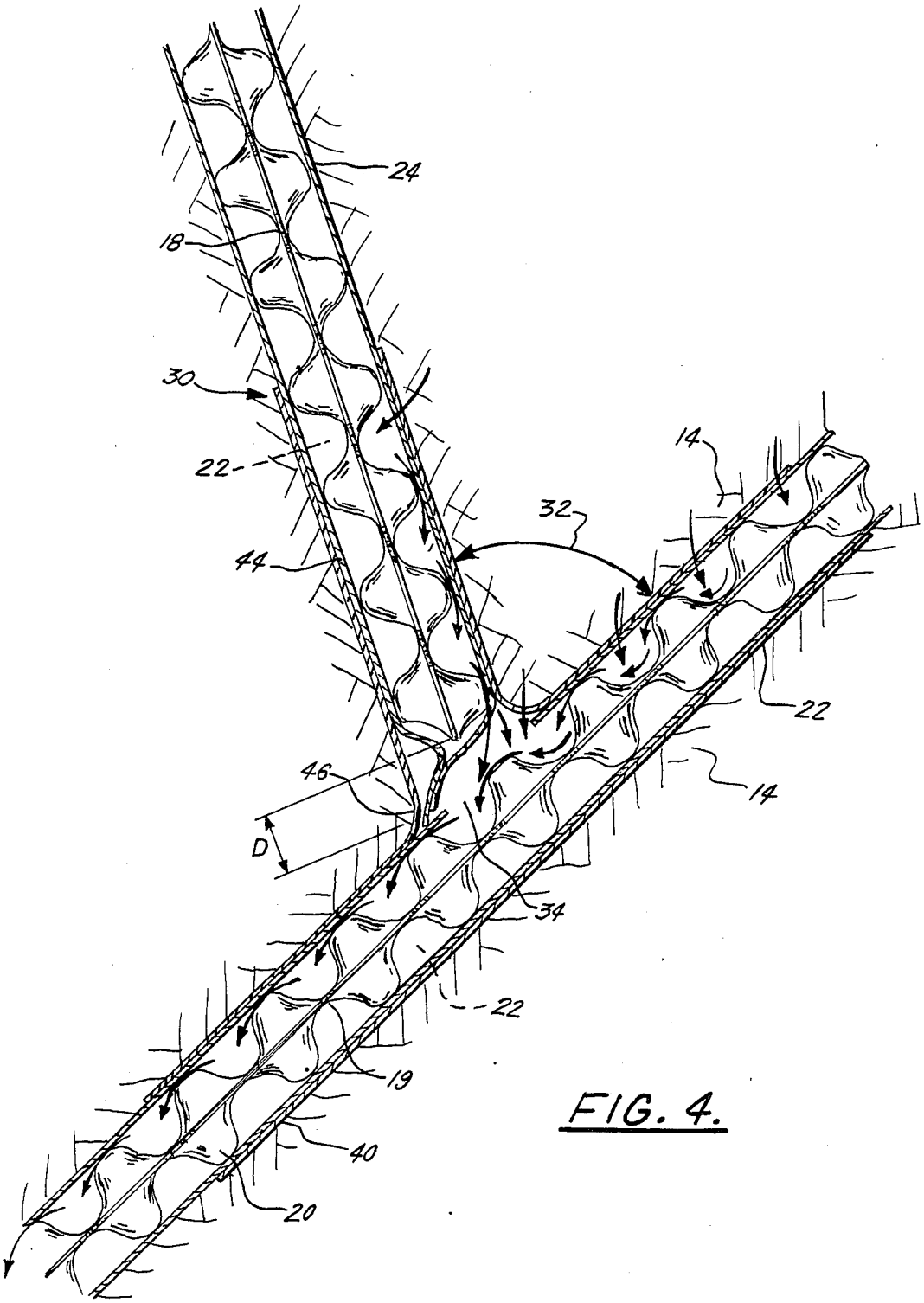
FIG. 4 is a top cross-sectional view of the preferred embodiment of the apparatus of the present invention.

The apparatus of the present invention is illustrated in FIGS. 1–4 by the numeral 10. Initially, the system under which this invention operates should be explained. As seen in the Figures, there is provided a main drainage flow line 12, which in the preferred setting would be situated in a trough or ditch at a particular point of drainage on a golf course or the like, to serve as a means for collecting water that is flowing out of the surrounding land media 14 as seen in FIG. 4. The drain provides substantially an elongated oval shaped line set on its bottom edge 16 on the floor of the ditch or trough into which it is situated. The drainage line 12 would comprise an internal flexible polystyrene core 18 which comprises, as seen particularly in FIG. 4, a flat main body portion 19 having a plurality of spaced apart raised members 20, the body portion 19 and raised members 20 forming a continuous sheet material with interspacial areas 22 between the various spaced apart raised members 20 to accommodate water flow therethrough.

As seen in the Figures, this core member 18 is cut into a strip, perferrably 6 inches to a foot in height, for being accommodated into the trough or ditch for drainage purposes.

There is further provided an external outer casing 24 which is a fabric of a geotextile layer that allows water to pass through into the interspaces 22 yet would filter out any soil or the like from the surrounding land 14. Because of the hydrostatic pressure that forces the water through the fabric 24 to the inside areas 22, there is no likewise pressure to force the water back out into the surrounding media. Therefore, given the inclination of approximately 1 degree, the water flow does take place along the length of the core member through the interspaces 22 and to a collection pond or ditch at one end portion of the drainage system.

As seen in the Figures, the outer fabric 24 covers the entire length of the core member 18 so that no foreign material such as dirt is allowed into the flow chambers 22.

Figure 5:
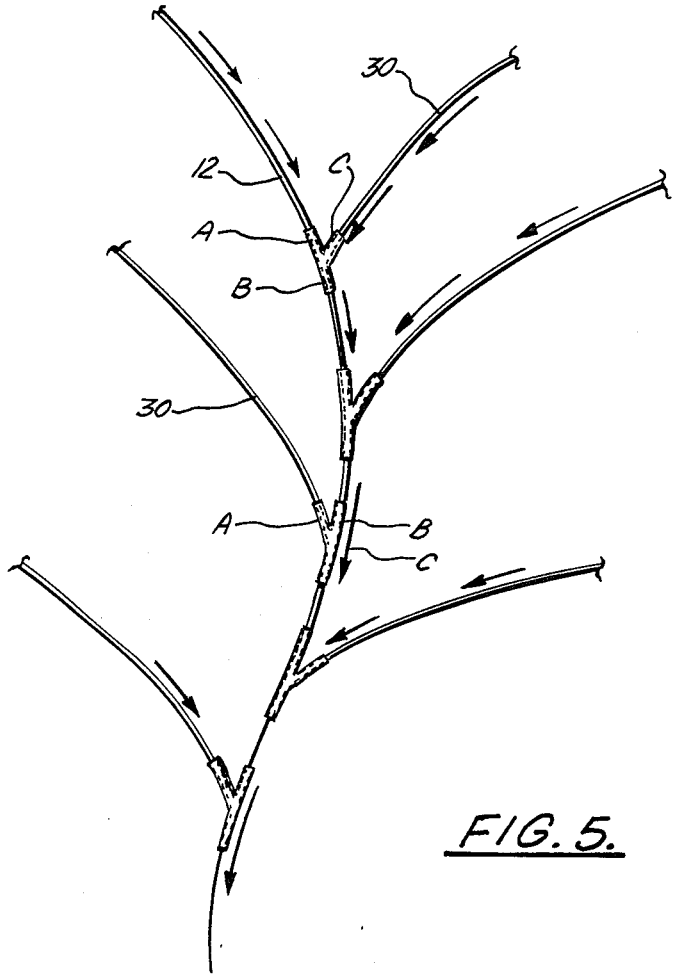
FIG. 5 is an overall view of the main and lateral drain system embodying the preferred embodiment of the apparatus of the present invention.

One of the necessary requirements of a good drainage system for a golf course or the like, is that in addition to the primary drain line 12 as seen in FIGS. 1–4, there are also included a plurality of lateral drain lines 30 "spliced" into the flow of main drain line 12 at proper points along the line. As seen in FIG. 5, flow throughout the entire land area of the, for example golf course, can be drained at a reasonable rate. The lateral drain lines 30 likewise further includes the inner flexible polystyrene core member 18 completely surrounded by the outer flexible geotextile filter number 24, and functionally operates in the same manner. As seen particularly in FIG. 4, it is necessary that the introduction of the lateral drain line 30 be introduced at an acute angle 32 of less than 90 degrees, in the direction of the flow, so that dynamically, the water flowing from the lateral line into the main line helps to accelerate the flow in the main line and to accelerate the overall drainage of the land area.

In order to accommodate this "splicing", of the lateral line 30 into the mainline 12, it is necessary that a window 34 be cut into one sidewall 36 of the main line 12 so that the end portion 37 of lateral line 30, as it is joined to mainline 12, allows water flowing through the spaces 22 of lateral line 30 to be introduced directly into the inner spaces 22 of mainline 12; that is, without having to be reabsorbed through the outer fabric layer 24.

Figure 1:
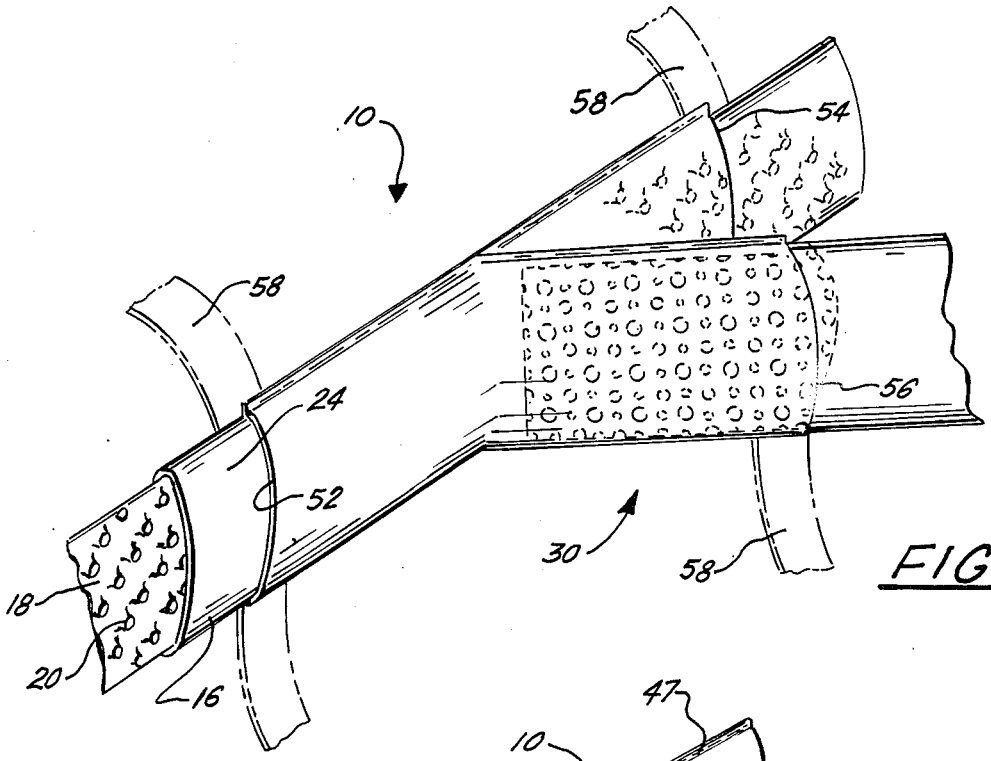
FIG. 1 is an overall perspective view of the preferred embodiment of the apparatus of the present invention.
Figure 2:
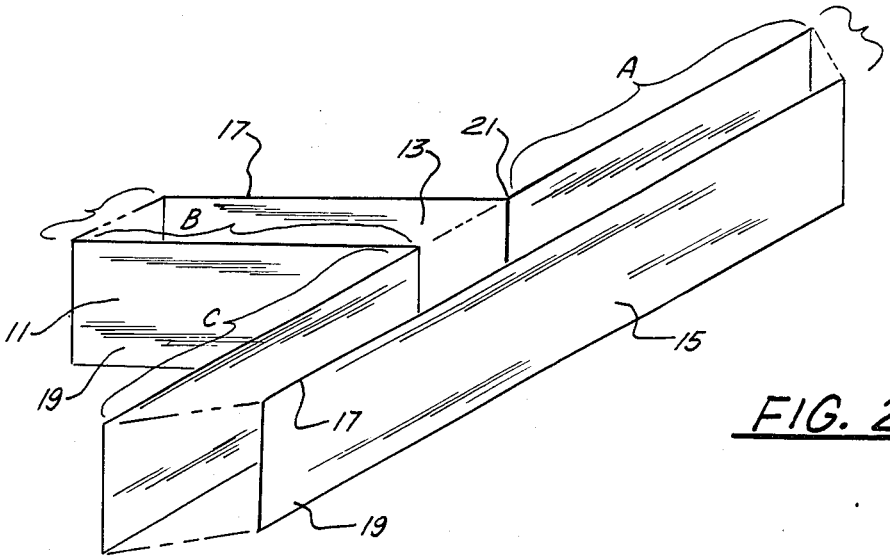
FIG. 2 is a representational view of the geotextile fabric sections comprising the preferred embodiment of the apparatus of the present invention.

To accommodate such a juncture between mainline 12 and lateral line 30, composite sleeve member 10 comes into play. As seen in FIG. 2, composite sleeve member 10 is constructed of three substantially equally length sections of geotextile fabric, 11, 13 and 15 respectively. For purposes of construction, as seen in FIG. 2, sections 11 and 13 are stitched at edges 17 and 19 to one another at least through mid point 21 of the length of the sections, sections 11 and 13 are stitched along the top and bottom edges 17 and 19 of portion 15. Therefore, FIG. 1 illustrates the composite member 10 as it is sewn together as previously described. It should be noted that due to this unique construction of the composite sleeve member 10, that the sleeve member in actuality has three portions A,B, and C which define the composite sleeve member.

It should be noted that as seen in FIGS. 1 and 5, the main line 12 is accommodated through at least 2 of the portions A and B or A and C depending on the entry i.e., either left or right of the lateral line. For example, as seen in FIG. 5, as lateral line 30 would enter on the right portion C would serve as an auxiliary sleeve with portions A and B serving to accommodate main line. For purposes of a lateral line 30 entering on the left, portion A would function to accommodate the lateral line and portions B and C would form that portion of the composite sleeve accommodating the main line 12. Therefore, the sleeve is interchangeable depending on left or right lateral line entries, as seen in the FIGURES.

For purposes of clarity, further description of the portion of the composite sleeve 10 that would accommodate the main line will be described as the "main sleeve portion 40", and the portion that will accommodate the auxiliary line will be described as auxiliary sleeve portion 44.

Main sleeve portion 40 has an internal opening 42 along its length so as to slidably be accommodated over the outer fabric portion 24 of main line 12 as seen in FIG. 3. Likewise, main sleeve portion 40 has an integral auxiliary sleeve portion 44, again of a similar width and height of main sleeve 40, and with a similar size opening 42 for being accommodated over the fabric portion of auxiliary or lateral flow line 30. As is seen in FIG. 4, the flow space within auxiliary sleeve 44 is in fluid communication with the flow space of main sleeve portion 40, at the point of connection 46. It should be noted that sleeve portion 40 and sleeve portion 44 are stitched or glued along their top edge 47 so as to be structurally sound in being slid over the main flow line and lateral flow lines.

Following the cutting of window 34 into the side wall 36 of main line 12, composite sleeve member 10 is then slidably accommodated over main line 12 as seen in FIG. 3, to a position where the point of juncture 46 between main sleeve 40 and auxiliary sleeve 44 is at the point of the opening 34, as seen particularly in FIG. 4. Following slidably positioning sleeve 10 to that point, lateral flow line 30 is then slid into space 42 of auxiliary sleeve 44, to a point to where it substantially abuts the juncture 46 of main sleeve 40 and auxiliary sleeve 44, but internal core 18 does not project into the flow spaces 22 of main line 12. This is crucial in that should the internal core member 18 of lateral flow line 30 extrude into flow space 22 of main line 12, there would be an interruption of flow in main line 12, which is undesirable. Following the positioning of the sleeve in the position as seen in the Figures, the end portions 52, 54 and 56 of the principal sleeve and auxiliary sleeve are sealably attached to the outer surface of main flow line 12, and auxiliary line 30 via a length of tape 58 which perhaps could be two sided adhesive tape for positioning in adhesively securing the sleeve member 10 to the main line and lateral line. This is vital to the overall operation, since the sealing of the end portions of the sleeve 10 would not therefore allow any flow of dirt or the like within the space between the wall of the flow lines and the interior wall of the sleeve and further into opening 34 for possibly interrupting any flow in the line.

It should be noted also in the Figures that the principal sleeve portion 40 and auxiliary sleeve portion 44 of composite sleeve 10 are such a length that there is a substantial amount of fabric extending away from the window 34, in all directions to help provide a further guard against the possible intrusion of dirt or the like between the sleeve and the line in the area of window 34.

Figure 7:
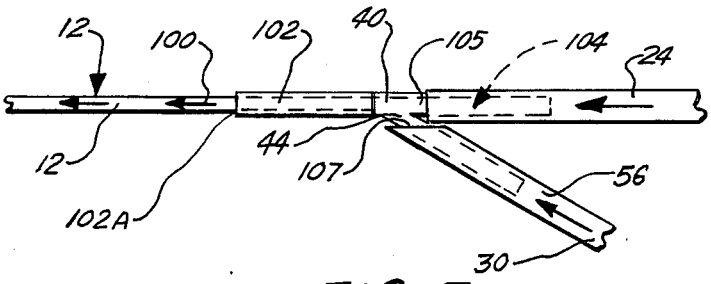
FIGS. 6 and 7 illustrate an alternate embodiment of the system of the present invention.
Figure 6:
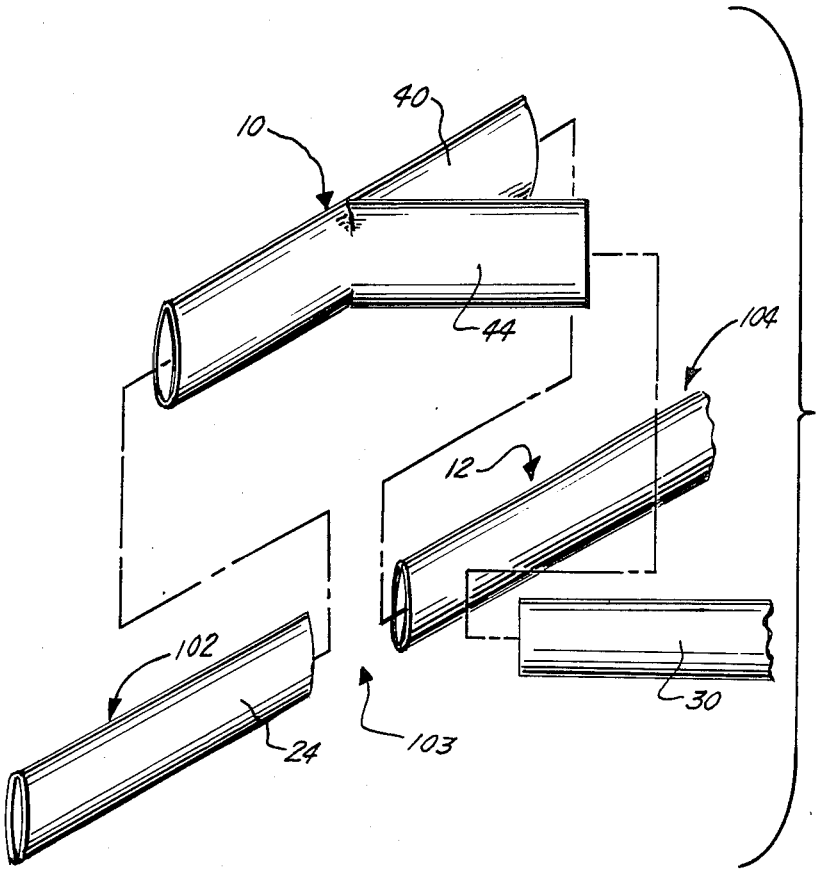

In an alternate embodiment of the apparatus of the present invention, there could be provided an assemblage combination between the sleeve member 10 and the main flow line 12 in auxiliary line 30 which would preclude the use of an adhesive tape as is used in the initial embodiment. FIGS. 6 and 7 illustrate the positioning of sleeve member 10 in this alternate embodiment.

During the construction and assemblage of the sleeve member onto the main line 12 and auxiliary line 30, it has been found that dirt or foreign particles will be hindered from entering the space between the fabric layers of main line 12 and sleeve 10 if the dirt or foreign material is required to move in the direction opposite the flow of water within the lines. That being the case, if for example, the flow of water is as seen in FIG. 7, the direction as indicated by arrow 100, and the fact that although the end portion 102A of sleeve 10 is exterior to the fabric main line 12, dirt or debris will be hindered from traversing that passage area between the fabric layers since the flow of water is in the opposite direction or in the direction of arrow 100.

Therefore, this embodiment, the sleeve member is accommodated and positioned onto the main line 12 and auxiliary line 30 in such a manner so as to coincide with the flow of water relative to the main sleeve portion 40 or auxiliary sleeve portion 44 of sleeve 10. For example, as seen in FIG. 7, with water flowing in the direction as seen by Arrow 100, in this embodiment, the fabric layer 24 of main line 12 could be severed at point 103 around its circumference so as to seperate the fabric into two sections, 102 and 104, as seen in FIG. 6. At this time, the portion of main portion 40 (portion 102) extending in the direction of the flow and downstream from the sever 103 would be placed external to the fabric portion 24 of main line 12. However, that portion of the main sleeve member 40 (portion 104) in the direction opposite the direction of the flow upstream of the sever 103 would be placed internal to the fabric portion 24 of main sleeve 12, so that any dirt or debris which may be entering at point 105 would be hindered due to the flow of water being the opposite direction. Likewise, since the lateral drain line 30 is entering main line 12 at a angle coinciding with the flow of the water, auxiliary sleeve member 44 would likewise be placed internally of auxiliary fabric layer 56, so that again dirt or debris would have to enter space 107 in the direction opposite flow of the water. Therefore, rather than depend on hindering the entry of dirt or debris into the flow by the use of adhesive tape, which is often unreliable particularly in that environment, the positioning of the entrance ways into main and auxiliary lines are crucial to hinder the flow of dirt or the like into the flow as provided as seen in FIGS. 6 and 7. Of course, were flow going in the opposite direction as illustrated in the FIGURE, the particular sleeve portions would be positioned in the opposite manner so that the flow of dirt or the like would be likewise hindered in the opposite direction i.e., in the direction of the flow.

Therefore, in summary, the main drain line having the internal core member in the external flexible fabric member allows fluid flow freely within its interior. At the juncture of the auxiliary line which also has an internal core member and an exterior fabric sleeve member surrounding the internal core member, the external flexible fabric member of the main drain line is divided into two sections substantially at the point of entry of the auxiliary line. The composite sleeve member which includes a main body portion is positioned onto the main drain line in such a manner that the portion of the composite sleeve member down stream of the entrance of the auxiliary line is placed exterior of the fabric layer of the main drain line, and that portion of the composite sleeve member up stream of the entry of the auxiliary line is placed interior to the fabric layer of the main drain line. In addition, that portion of the auxiliary sleeve which accommodates the auxiliary line is likewise placed interior of the fabric of the auxiliary line. In this manner, all of the possible entrance ways of dirt into the system are obstructed due to the flow of the water in the opposite direction in the main drain line.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. In an underground drainage system which includes a main drain line of a height substantially greater than its width, the drain line including an internal rigid core member and a substantially flexible geotextile fabric encasement, allowing water flow between the rigid core and the fabric, an apparatus for securing a lateral drain of similar construction to the main drain line, the apparatus comprising:

a. a flexible principal body portion comprising geotextile fabric completely encasing a portion of the main drain line;

b. a flexible auxiliary body portion, likewise comprising geotextile fabric, flexibly secured to the principal body portion, the auxiliary body portion surrounding the lateral drain line;

c. an opening in the wall of the fabric encasement at the point of attachment of the auxiliary body portion to the principal body portion so that fluid flow is allowed from the lateral drain line into the main drain line; and d. means for sealing the end points of the principal body portion and the auxiliary body portion to the exterior of the main drain line so that foreign particles can not enter the juncture of the main drain line and the lateral drain line.

2. The apparatus in claim 1, the means for allowing the auxiliary line to come into fluid contact with the main drain line further comprises a window cut into the side wall of the main drain line.

3. The apparatus in claim 1, wherein the means for sealing the end portions of the body portions further comprises adhesive tape, two sided tape, silcon or the like substance.

4. The apparatus in claim 1, wherein the main drain line and auxiliary drain line further includes an internal polystyrene core member providing a noncollapsable fluid flow space within the main drain and auxiliary drain lines.

5. In a system for draining land areas, which includes a main drain line having an internal core member surrounded by an outer fabric filter material and a window cut into the fabric material to accommodate a lateral drain line also including an internal core member surrounded by an outer fabric filter material, a flexible sleeve apparatus for connecting the lateral drain line to the main drain line, comprising:

a flexible principal body portion, formed of first, second, and third auxiliary body portions, each auxiliary body portion open ended at a first end and joined together at their second ends to form the principal body portion, at least the first and second auxiliary body portions defining a continuous sleeve slidable around portion the main drain line and the third auxiliary body portion defining an entry sleeve slidable over the lateral drain line, so that the principal body portion connects the lateral drain line to the main drain line, each auxiliary body portion being constructed of a material such that it is flexibly interchangeable between use in the continuous sleeve and in the entry sleeve.

6. The system in claim 5, wherein there is further provided means for sealing the end portions of the main body portion and the auxiliary body portion for preventing foreign materials from entering the space between the sleeve member and the main drain and the lateral drain.

7. The system in claim 5, wherein the core member of the lateral drain is positioned to abut the core member of the main drain so as not to impede the flow of water through the main drain line.

8. The system in claim 5, wherein the means for positioning the lateral drain core member substantially abutting the main drainage core member further includes a window cut into the wall of the main drain line.

9. In an underground drainage system which includes a drain line with a height substantially greater than its width, the drain line including an internal rigid core member and a substantially flexible geotextile fabric encasement, allowing water flow between the rigid core member and the fabric encasement, a multi-sleeve apparatus for connecting a lateral drain line to a main drain line, the apparatus comprising:

a. a flexible principal body portion formed of first, second, and third substantially identical auxiliary body portions, each of said auxiliary body portions open ended at a first end and joined together at their second ends for forming the principal body portion, so that when the lateral drain line enters from a first side of the main drain line the first and second auxiliary body portions define a first sleeve slidable around the main drain line, and the third auxiliary body portion defines a second sleeve slidable over the lateral drain line, and when the lateral drain line enters the main drain line from a second side of the main drain line, the first and third auxiliary body portions define a first sleeve slidable over the main drain line, and the second auxiliary body portion defines a second sleeve slidable over the lateral drain line.

* * * * *